US007487881B2

(12) United States Patent
Watzke et al.

(10) Patent No.: US 7,487,881 B2
(45) Date of Patent: Feb. 10, 2009

(54) DUAL CHAMBER SALAD CONTAINER

(75) Inventors: David Watzke, Placentia, CA (US); Maureen Watzke, Placentia, CA (US)

(73) Assignee: Form Plastics Company, St. Charles, IL (US)

( * ) Notice: Subject to any disclaimer, the term of this patent is extended or adjusted under 35 U.S.C. 154(b) by 0 days.

(21) Appl. No.: 10/723,575

(22) Filed: Nov. 26, 2003

(65) Prior Publication Data

US 2004/0200845 A1 Oct. 14, 2004

Related U.S. Application Data

(63) Continuation-in-part of application No. 10/412,008, filed on Apr. 11, 2003, now abandoned.

(51) Int. Cl.
*A47G 19/02* (2006.01)
*B65D 25/04* (2006.01)
*B65D 1/24* (2006.01)

(52) U.S. Cl. ..... 220/501; 220/529; 220/575; 220/592.01; 220/669

(58) Field of Classification Search ..... 220/501, 220/529, 575, 592.01, 669
See application file for complete search history.

(56) References Cited

U.S. PATENT DOCUMENTS

| | | | | | |
|---|---|---|---|---|---|
| 86,698 | A | * | 2/1869 | Sawyer | 220/501 |
| 672,994 | A | | 4/1901 | Wacker | |
| 1,878,924 | A | | 9/1932 | Will | |
| 2,712,668 | A | * | 7/1955 | Thiele | 15/264 |
| 2,850,391 | A | * | 9/1958 | Gunsberg | 426/109 |
| 3,040,897 | A | | 6/1962 | Holman | |
| 3,052,246 | A | | 9/1962 | Beard | |
| 3,360,161 | A | | 12/1967 | Smith | |
| 3,710,589 | A | | 1/1973 | Brown et al. | |
| 3,989,158 | A | * | 11/1976 | Florian | 220/23.83 |
| 4,003,490 | A | | 1/1977 | Corbic nee Busnel | |
| 4,018,355 | A | | 4/1977 | Ando | |
| 4,027,779 | A | | 6/1977 | De Long | |
| 4,114,784 | A | | 9/1978 | Hough et al. | |

(Continued)

FOREIGN PATENT DOCUMENTS

| | | |
|---|---|---|
| DE | 4213266 | 10/1993 |

(Continued)

OTHER PUBLICATIONS

No Author, "WorldStar—Faerch Plast wins global award for modern packaging," 2001.

(Continued)

*Primary Examiner*—Anthony D Stashick
*Assistant Examiner*—Niki M Eloshway
(74) *Attorney, Agent, or Firm*—Loeb & Loeb LLP

(57) ABSTRACT

A salad container having a container body with an open top, an exterior surface and an interior surface defining a cavity, the cavity divided into an upper chamber and a lower chamber by a selective barrier cooperatively configured to rest on the interior surface of the body to selectively exclude relatively large ingredients such as salad roughage from entry into the lower chamber and to provide passage therethrough of relatively small food ingredients, such as granular ingredients including, for example, ground pepper and/or such as liquids, including, for example, salad dressing, into and out of the lower chamber.

21 Claims, 6 Drawing Sheets

U.S. PATENT DOCUMENTS 4,147,277 A * 4/1979 Bateman et al. ..... 220/574.2
4,324,338 A 4/1982 Beall
4,333,581 A 6/1982 Flansburg
4,419,371 A 12/1983 Suderman
4,444,324 A 4/1984 Grenell
4,520,633 A 6/1985 Hoydic
4,529,089 A 7/1985 Gasbarra et al.
4,627,986 A 12/1986 Bardsley et al.
4,803,088 A 2/1989 Yamamoto et al.
4,874,618 A 10/1989 Seaborne et al.
4,883,935 A 11/1989 Fairchild et al.
5,035,320 A 7/1991 Plone
5,083,674 A 1/1992 Clark
5,085,330 A 2/1992 Paulin
5,176,282 A 1/1993 Rapaz
5,242,077 A 9/1993 Smith et al.
5,271,508 A * 12/1993 Gamwell ..... 209/682
5,279,841 A 1/1994 Yu
5,358,330 A 10/1994 Moll
5,372,274 A 12/1994 Freedland
5,402,908 A * 4/1995 Warden et al. ..... 220/554
5,425,196 A 6/1995 Schwarze
5,447,236 A 9/1995 Perry et al.
5,464,150 A 11/1995 Porres Sanchez et al.
5,575,848 A 11/1996 Chedville
RE35,437 E 2/1997 Ascone
5,676,244 A 10/1997 Green
5,676,275 A * 10/1997 Khattar ..... 220/575
5,718,933 A 2/1998 Fultz
5,727,679 A 3/1998 Newarski
5,799,866 A 9/1998 Hattem
5,871,116 A 2/1999 Picchietti
5,984,137 A * 11/1999 Grosjean ..... 220/789
6,021,903 A 2/2000 Hanson
6,042,858 A 3/2000 Kairys
6,047,845 A 4/2000 Rapaz
6,068,865 A 5/2000 Lee et al.
6,073,795 A * 6/2000 Longstreth ..... 220/574
6,089,375 A 7/2000 Johnson et al.
6,099,812 A * 8/2000 Allen et al. ..... 422/300
6,153,237 A * 11/2000 Ferguson ..... 426/115
6,196,406 B1 3/2001 Ennis
6,276,555 B1 8/2001 Edwards
6,279,744 B1 8/2001 Yu
6,302,268 B1 10/2001 Michaeli
6,367,409 B1 * 4/2002 Broom ..... 118/13
6,378,325 B1 4/2002 Yang
6,390,292 B2 5/2002 Hawthorne
6,395,320 B1 5/2002 Hazell et al.
6,528,105 B1 3/2003 Gerhart et al.
6,641,854 B2 11/2003 Gerhart et al.
6,913,777 B2 7/2005 Rebhorn et al.
6,951,275 B2 10/2005 Serra Galdos
2003/0031769 A1 2/2003 Wyslotsky

FOREIGN PATENT DOCUMENTS

GB 2340823 3/2000

OTHER PUBLICATIONS

Photos (pp. 1-3) of clear plastic article having channel elements in bottom. Patent application believed to be pending, but date of application and invention unknown.
Faerch Inside, Dec. 2001, No. 4, p. 3.
United States Board of Patent Appeals and Interferences Decision for U.S. Appl. No. 10/412,008, filed Mar. 28, 2008.

* cited by examiner

DUAL CHAMBER SALAD CONTAINER

PRIORITY DOCUMENTS

This is a continuation-in-part of application Ser. No. 10/412,008 filed on Apr. 11, 2003, now abandoned, and which is incorporated herein.

BACKGROUND OF THE INVENTION

In the food service industry, it has long been desirable to delay mixing certain food ingredients together until just prior to consumption. The service of fresh green salad is one such example. Dressing added to the salad just prior to its consumption advantageously preserves the freshness, crispness, and distinctive taste of the greens, croutons, and other rough ingredients that are susceptible to dressing absorption. All too frequently, dressing is applied to roughage too early resulting in a drenched, wilted, and limp concoction that is rejected by consumers as inferior. When ordering a Caesar salad, for instance, it is traditional for the salad dressing to be prepared tableside and then rapidly tossed with the other ingredients such as romaine lettuce and croutons for immediate transfer onto a diner's plate for enjoyment. Tableside preparation, however, is costly and time consuming and not particularly well suited to the fast-food or high volume food service industries.

Consumers, restaurateurs, the fast-food industry, and institutional food preparation services continue to demand food products that are high quality, convenient, quick to prepare, and economical to produce. Fast-food outlets, for example, frequently offer pre-prepared salad roughage such as greens, croutons, radishes, cucumbers, carrots, meat and/or cheese combined together in a disposable individual container. The salad dressing, however, is frequently offered in a separate packet that requires cumbersome handling and opening before the contents therein are squeezed out onto the roughage. Typically, the roughage container also includes a lid that must be removed before the packet contents are added thereover. Once the container lid is removed, the dressing packet is torn open and the dressing therein is squeezed out and onto the roughage. Implements such as a fork, spoon or knife, individually or in combination, are then used to distribute the dressing throughout the roughage. The action required of the implements to distribute the dressing often results in substantial amounts of ingredients and dressing disadvantageously overflowing and tumbling out of the container onto the table, the clothes of the consumer, and, not infrequently, onto the floor.

Schools and other high volume institutions provide similar individual holding containers for salad roughage. The salad dressing, however, is frequently offered in a separate portion cup to be added atop the salad greens. Similarly, to thoroughly distribute the dressing among the roughage requires use of implements resulting in spillage and mess. Moreover, both dressing packets and portion cups are costly and inconvenient and require significant dexterous manipulation to use.

Large commercial eateries often separately store salad roughage in large plastic bins and dressing in other containers until it is desirable for both to be combined and mixed together just prior to serving. Once the desired dressing and roughage containers are located and opened, the dressing is poured onto the roughage. Alternatively, and depending on the size of the dressing container, the roughage may be introduced to the dressing. In either case, use of implements to toss the salad and distribute the dressing soon follows with its attendant and disadvantageous spillage, waste and mess.

From the salad remaining in the mixing container, individual portions are then distributed onto individual plates and served.

There thus exists a long felt need for an improved salad container that eliminates the need to store, in separate containers, large ingredients such as salad roughage apart from smaller or liquid ingredients, such as salad dressing, until mixing them together is desired. It has been further long desired that a container be provided to eliminate the need to use mixing or tossing implements and the undesirable spillage, waste and mess resulting from use thereof.

SUMMARY OF THE INVENTION

Generally, the present invention comprises a salad container having a container body with an open top, an exterior surface and an interior surface defining a cavity, the cavity divided into an upper chamber and a lower chamber by a selective barrier secured to the interior surface of the body to selectively exclude relatively large ingredients such as salad roughage from entry into the lower chamber and to provide passage therethrough of relatively small food ingredients, such as granular ingredients including, for example, ground pepper and/or liquids such as salad dressing, into and out of the lower chamber. In at least one embodiment of the present invention, the barrier is integrally secured to the body. In another embodiment, the barrier is releasably secured to the body. Each of the embodiments may include a detachable lid which may be used, for example, to close the container body when desired for storage of contents therein and/or for inverting the container passing the contents of the lower chamber into the upper chamber and shakingly mixing together the contents of both chambers without need of implements.

In another embodiment, the present invention comprises a salad container having a container body with an open top, an exterior surface, and an interior surface defining a cavity, the interior surface having a downwardly inward tapering portion, and a selective barrier cooperatively configured to be positioned on the tapering portion to divide the cavity into an upper chamber and a lower chamber. The barrier is configured with at least one opening therethrough to selectively exclude relatively large ingredients such as salad roughage from entry into the lower chamber and provide passage therethrough of relatively small food ingredients, such as granular ingredients including, for example, ground pepper and/or liquids such as salad dressing, into and out of the lower chamber.

In at least one embodiment of the present invention, the interior surface of the body includes at least one inwardly projecting protrusion upon which the barrier may gravitationally rest when the container body is in an upright position. In another embodiment, the interior surface of the body includes an inwardly tapered portion upon which the barrier may gravitationally rest dividing the cavity into an upper and lower chamber. In a further embodiment, the barrier is cooperatively configured with the body to be wedged to the interior surface of the body. Each of the embodiments may optionally include a detachable lid which may be used, for example, to close the container body when desired and/or for inverting the container and shakingly mixing together the contents of both chambers without need of implements.

These and other features and advantages of the present invention will become apparent from the following detailed description which taken in conjunction with the accompanying drawings, further describes and illustrates by way of example the principles of the invention.

DETAILED DESCRIPTION OF PREFERRED EMBODIMENTS

Figure 1:
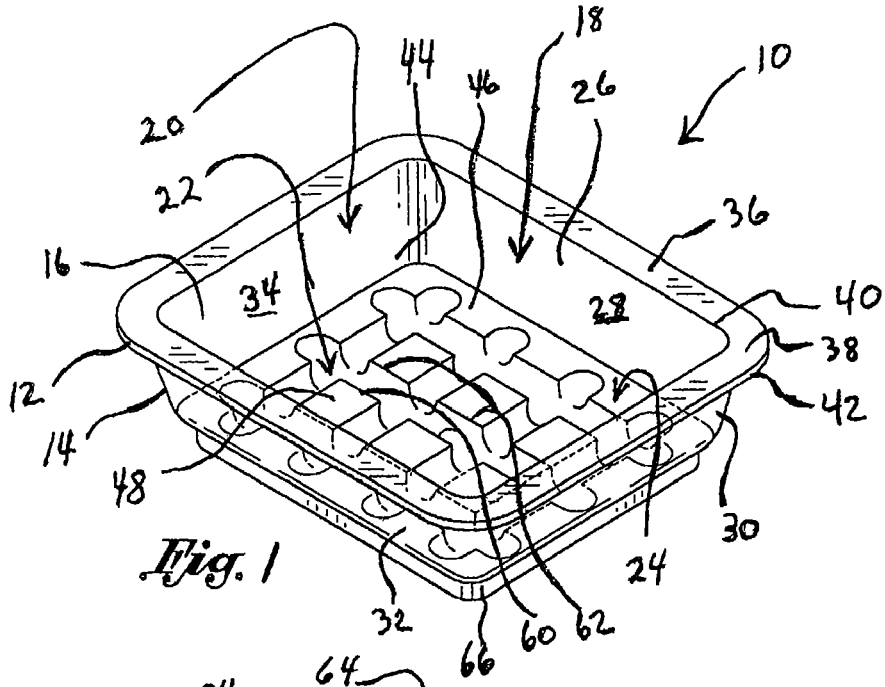
FIG. 1 is a perspective view of an embodiment of the present invention wherein the barrier is formed as an integral part of the container body.
Figure 2:
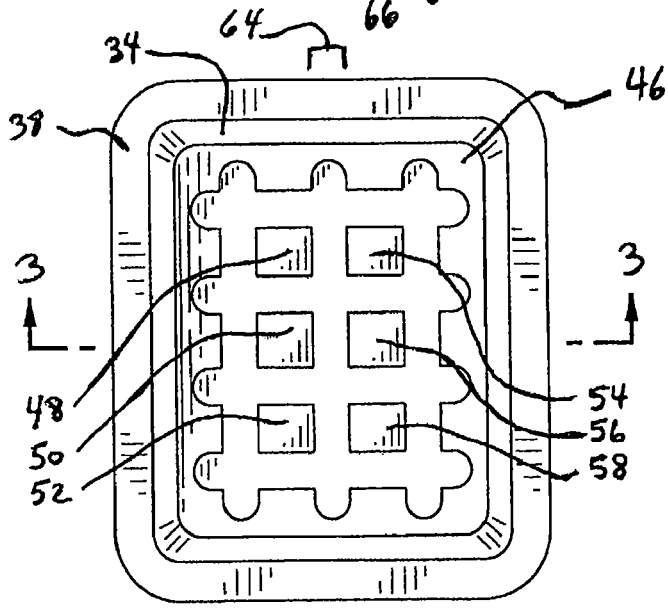
FIG. 2 is a top view of an embodiment of the present invention wherein the barrier is formed as part of the container body.

Referring first to FIGS. 1 and 2, generally designated by the numeral 10 is a preferred embodiment of the salad container of the present invention. The container of this embodiment is sized for an individual salad comprising a rectangular-shaped unitary container body 12 having an imaginary central vertical axis, an open top, an exterior surface 14 and an interior surface 16 defining a cavity 18, the cavity divided into an upper chamber 20 and a lower chamber 22 by a selective barrier 24 having an opening comprising a grid of interconnected trough depressions defining the lower chamber.

The upper chamber 20 is laterally defined by a nearly vertical radially contiguous body wall having an interior wall surface 26 comprising four interconnected panel surfaces 28, 30, 32, and 34, the interior wall surface terminating in height in a contiguous rim 36 having a horizontal rim surface 38 and an inner and outer rim edge 40 and 42 respectively, the interior wall surface tapering inwardly on descent and terminating in a radially contiguous interior wall bottom surface 44. Integrally secured to the interior wall bottom surface is a plurality of upwardly facing barrier surfaces including a perimeter barrier surface 46 and six interior barrier surfaces 48, 50, 52, 54, 56, and 58 integrally connected to the trough depressions therebetween, the crossing trough depressions isolating the barrier surfaces from one another, the grid opening cooperating with the barrier surfaces to form the selective barrier 24.

The troughs are arranged in parallel and perpendicularly crossing configuration, each trough having opposing longitudinally parallel interior surface top edges 60 and 62 connected to adjacent barrier surfaces and positioned sufficiently apart by a distance 64 to selectively exclude relatively large ingredients, such as salad roughage, from entry into the lower chamber and to provide passage therethrough of relatively small food ingredients, such as granular ingredients, including, for example, ground pepper and/or such as liquids, including, for example, salad dressing, into and out of the lower chamber. In the present embodiment, the distance across opposing parallel interior surface trough edges is about one fourth of an inch. This distance may be varied depending on the size of ingredients desired to be thwarted from entry into the lower chamber.

Extending from the exterior surface 14 of the underside of the body 12 is an optional stand 66 to support the container at rest on a level surface. In alternative embodiments, the stand may be omitted, the body thus resting directly on the exterior surface 14 of the trough bottoms (not shown). The omission of a stand may also provide for close nesting together of multiple containers. The container of the present invention may be reused or may be discarded, the opening formed by the grid of troughs providing easy access to the lower chamber for cleaning.

Figure 3:
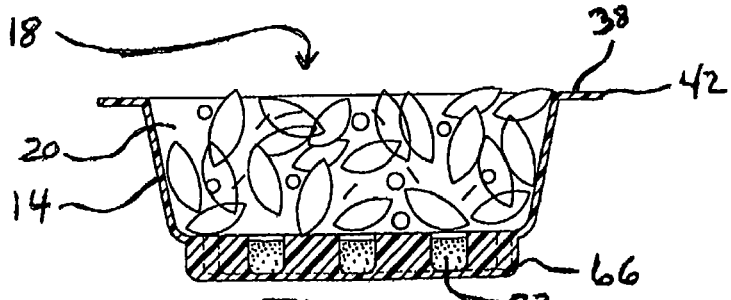
FIG. 3 is cross sectional view along the lines depicted in FIG. 2 with added salad roughage in the upper chamber and added dressing in the lower chamber.

Referring to FIG. 3, a cross-section of the present preferred embodiment is shown representing salad roughage being supported in the upper chamber 20 and dressing residing in at least three troughs of the lower chamber 22 in a storage configuration, the selective barrier surfaces blocking entry of roughage into the lower chamber and desirably preventing the roughage from lying in the dressing and becoming soaked and wilted thereby. The relatively small ingredients or dressing may be preloaded into the lower chamber 22 before the roughage is added, may be injected into the lower chamber beneath the roughage, may be added on top of the roughage, or may gravitationally flow from the lower chamber into the upper chamber once the container body is inverted as desired. The lower chamber also may provide a reservoir for the collection of liquid such as water from freshly washed roughage or excess dressing as desired.

Alternative embodiments of the container body may utilize, for example, one or more upwardly facing barrier surfaces and at least one opening cooperatively forming the selective barrier. For example, in one alternative embodiment (not shown), the upwardly facing barrier surface may be limited to a central island surrounded by an annular trough defining the lower chamber, the opening to the lower chamber and the upwardly facing barrier surface cooperatively forming the selective barrier. More specifically, the embodiment includes a cylindrically shaped body with an open top having a downwardly extending body wall turned inwardly at its bottom to form a stand and upwardly terminating in a radially contiguous inner wall, the inner surface of the inner wall apart from and facing in opposition the interior surface of the body wall defining an annular lower chamber, the inner surface of the inner wall having a radially contiguous inner wall top edge, the inner wall top edge being integrally secured to the perimeter of a single centrally positioned upwardly facing barrier surface, a single surrounding opening formed between the inner wall top edge and the interior surface of the body wall and cooperating with the barrier surface to provide a selective barrier to exclude relatively large ingredients from entry into the lower chamber and provide passage therethrough of relatively small food ingredients into and out of the lower chamber. In another embodiment (not shown), the selective barrier includes an opening comprising a depression configured in the form of a spirally configured channel defining the lower chamber, the spiral channel having a pair of channel walls with channel top edges, the channel top edges being connected adjacently to a spirally configured upwardly facing barrier surface.

The container of the present invention 10 may also include a lid (not shown) to cover the cavity 18 for covered storage of roughage and dressing therein and/or for shakingly mixing the contents therein together without use of implements. Distribution of dressing throughout the roughage may be provided without use of implements and the attendant spillage and mess caused by usage thereby, by flipping over and shaking the covered container and its contents, the dressing from the lower chamber 22 flowing into the upper chamber 20 and being shakenly distributed throughout the roughage as desired. The lid may be configured, for example, as a domed or flat snapably securable resilient cover or may be foil or plastic film sheeting or other varieties as are known in the art.

Figure 4:
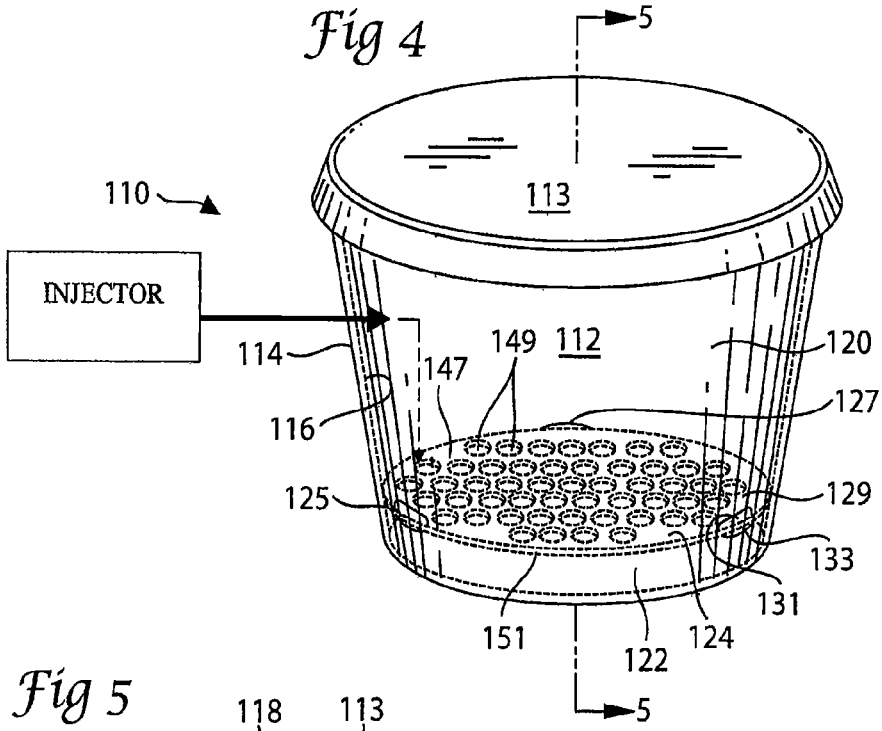
FIG. 4 is a perspective view of an embodiment of the present invention wherein the barrier is secured to the interior wall of the container body.
Figure 5:
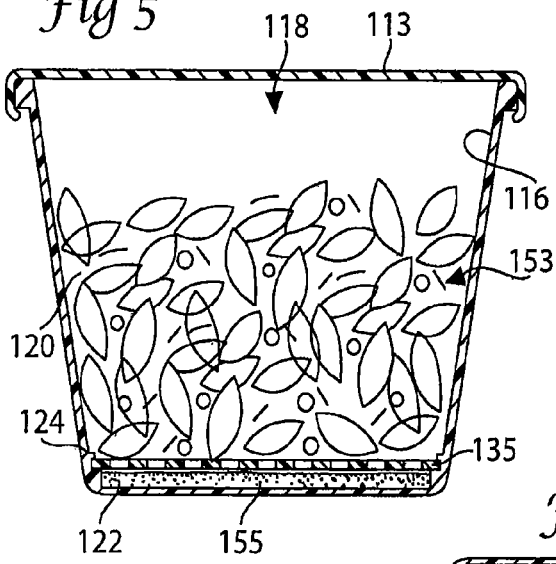
FIG. 5 is an offset cross sectional view along the lines depicted in FIG. 4 through two of the three barrier retainers with added salad roughage in the upper chamber and added dressing in shortened lower chamber.

Referring to FIGS. 4 and 5, is shown an alternative embodiment of the present invention. Shown is a container 110 having a cylindrical downwardly tapering container body 112 having an exterior surface 114 and an interior surface 116 defining a cavity 118 and including a securable lid 113, the cavity divided into an upper chamber 120 and a lower chamber 122 by a selective barrier 124 releasably secured to the interior surface of the body by three barrier retainers 125, 127, and 129 formed on the interior surface of the body, each retainer having an upper portion 131 and a lower portion 133. The selective barrier includes an upwardly facing barrier surface 147, and a plurality of openings 149 therethrough of sufficient dimension to selectively exclude relatively large ingredients 153 such as salad roughage from entry into the lower chamber and to provide passage therethrough of relatively small food ingredients, such as granular ingredients 155 including, for example, ground pepper and/or such as liquids, including, for example, salad dressing, into and out of the lower chamber.

In the present embodiment, each opening is bounded by a vertically tubular inner wall having a diameter of about one fourth of an inch. This distance may be varied depending on the size of ingredients desired to be thwarted from entry into the lower chamber 122. The barrier may alternatively be configured to include inner walls defining the barrier openings in a variety of configurations including slotted forms, upwardly or downwardly projecting nozzles, and/or other shapes known in the art.

The barrier retainers 125, 127, and 129 may be in the form of small ribs, nodes, bosses, or protrusions each having a notch 135 between the upper and lower portions 131, 133, the barrier 124 and the body 112 being sized and configured with sufficient cooperative flexibility for the barrier to be press fit into the notches securing the barrier in position dividing the cavity into the upper chamber 120 and lower chamber 122. The barrier and body are also cooperatively configured to provide for the removal of the barrier by grasping the barrier through at least one of its openings with fingertips or a small hooked implement (not shown). A gripping post (not shown) or other removal enhancing feature may be formed on the upwardly facing barrier surface 147 as desired. Removal of the barrier provides for ease of cleaning, ease of reuse, and for a container body that may be converted, as desired, to use without the barrier dividing the cavity into upper and lower chambers.

The upper portion 131 of each barrier retainer functions to retain the barrier 124 in operable position preventing it from prematurely dislodging when the container body 112 is inverted. Alternatively, the container body may be provided without the lower portion 133 of each retainer should the barrier be sized with a barrier edge 151 to sufficiently interfere with the downwardly tapering interior surface 116 of the body at a location just beneath the upper portions of the retainers and above the bottom of the lower chamber 122. Optionally, the interior wall of the body may be formed with a retaining annular slot for securing the barrier. Alternatively, the barrier may be permanently secured to the interior surface of the body at securing points on the interior surface of the body wall or may be releasably or permanently secured circumferentially at the barrier edge to the interior surface by methods and apparatus known in the art. Although optional, it is not required that the barrier edge be sealingly secured to the interior surface of the body. Alternatively, at least one opening may be located only through the barrier edge. Optionally, the barrier may include only a single opening for passage of dressing or small ingredients into and out of the lower chamber. Additionally optionally, the salad container may configured in the form of a kit comprising the container body and the releasably securable selective barrier.

Figure 6:
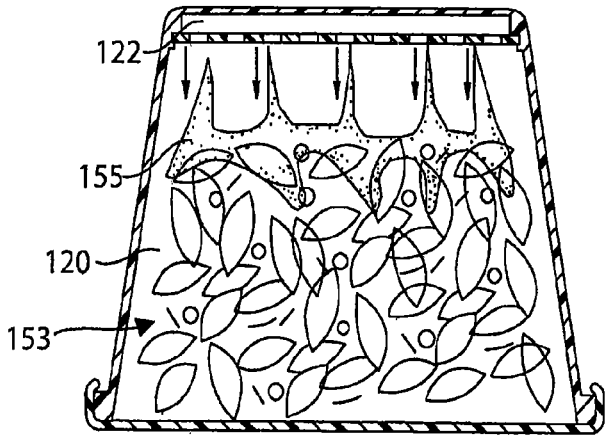
FIG. 6 is an inverted view of the cross sectional view of FIG. 5 showing the dressing gravitationally flowing into the upper chamber.

Referring to FIG. 6, the container 110 is shown inverted, the dressing (or other granular or small ingredients) 155 in the lower chamber 122 shown gravitationally dripping through the openings in the selective barrier 124 and over the roughage (or other large ingredients) 153 contained in the upper chamber 120. Alternatively, the optional lid may not be deployed, the container body 112 being invertible directly onto a plate with roughage and dressing in the upper and lower chambers respectively, the dressing gravitationally flowing onto the roughage from the lower chamber of the inverted body, the body being removable away from the contents when desired.

Figure 7:
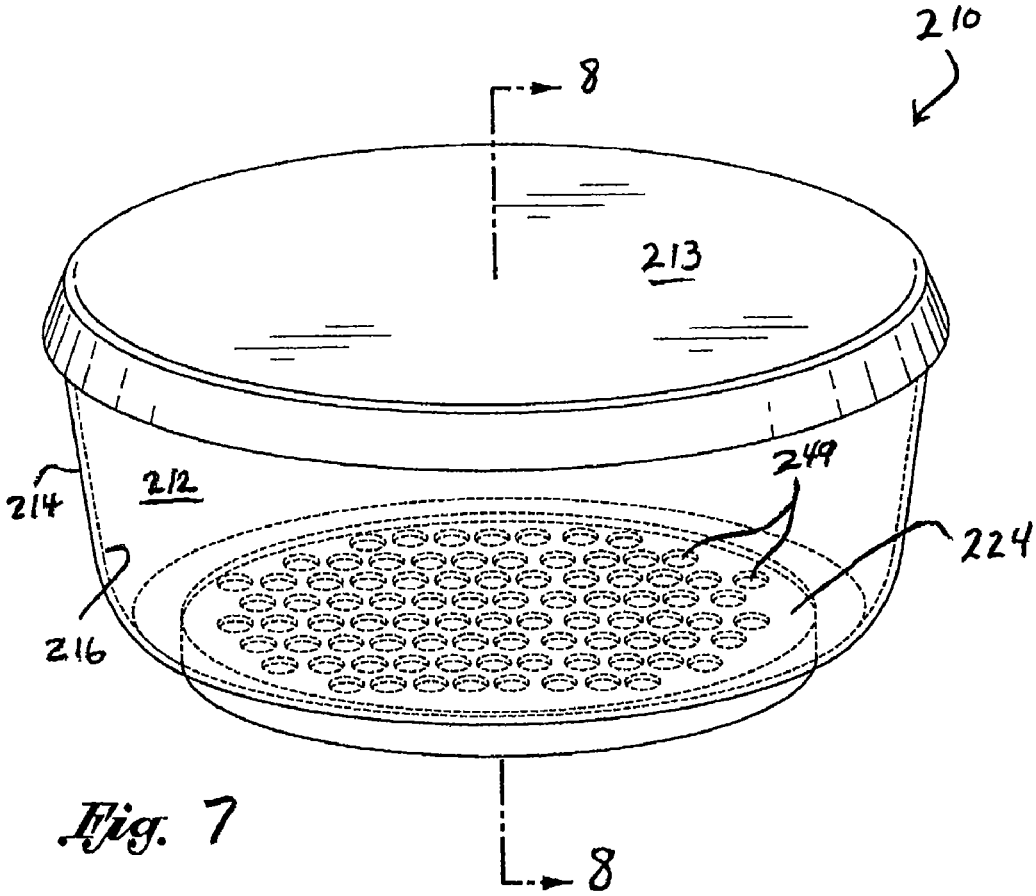
FIG. 7 is a perspective view of an embodiment of the present invention wherein the barrier is secured beneath a deformable rim in the interior surface of the container body.
Figure 8:
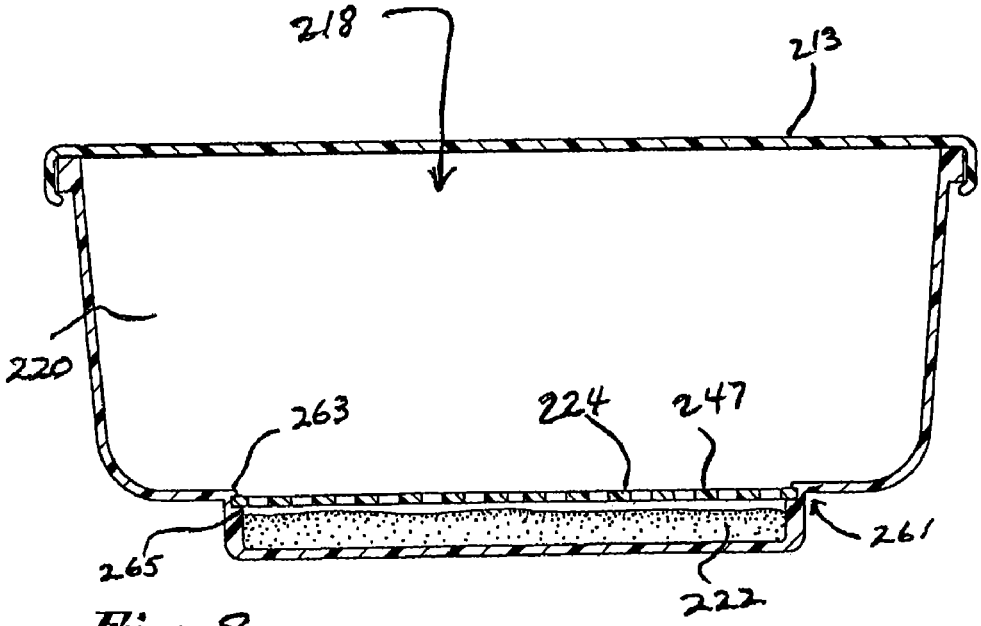
FIG. 8 is a cross sectional view along the lines depicted in FIG. 7 with added dressing in the lower chamber.

Referring to FIGS. 7 and 8, a larger commercial sized container 210 is shown having a container body 212 with an open top, an exterior surface 214, and an interior surface 216 defining a cavity 218, and including a securable lid 213 to cover the open top, the cavity divided into an upper chamber 220 and a lower chamber 222 by a selective barrier 224 releasably secured to the interior surface of the body by an annular barrier retainer 261 formed on the interior surface of the body, the retainer having an annular upper rim 263 and an annular seat 265 formed to secureably receive the barrier. The selective barrier includes an upwardly facing barrier surface 247, and a plurality of openings 249 therethrough of sufficient dimension to selectively exclude relatively large ingredients such as salad roughage from entry into the lower chamber and to provide passage therethrough of relatively small food ingredients, such as granular ingredients including, for example, ground pepper and/or such as liquids, including, for example, salad dressing, into and out of the lower chamber.

The container of the present invention may be formed, for example, from polystyrene, polyethylene, polypropylene, or other plastics by methods known to those of skill in the art. Other materials, such as, for example, rigidized paper or pulp materials may be employed as would be known in the art. Metal, such as, for example, stainless steel or aluminum may also be employed as desired. The components of the present invention may also be made from differing materials. By way of example, the container body may be made of stainless steel and the barrier may be made of plastic material.

Figure 9:
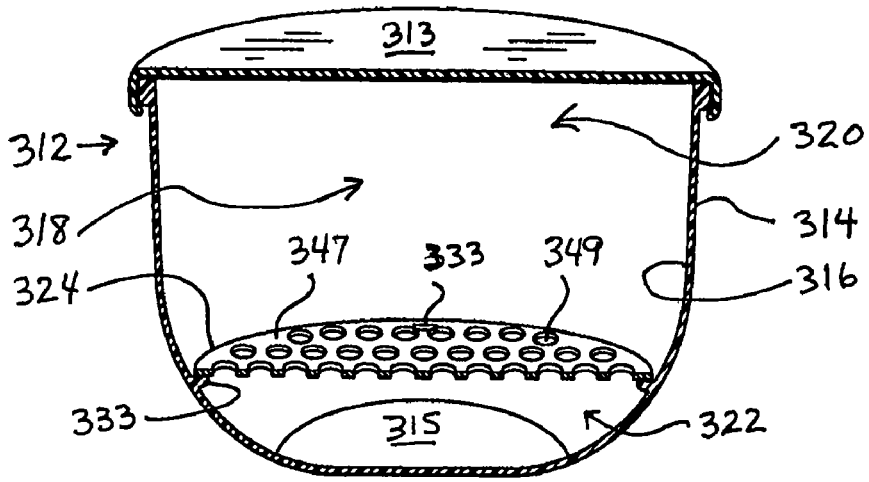
FIG. 9 is a cross-sectional perspective view of an embodiment of the present invention including a lid wherein the selective barrier is at gravitational rest on a plurality of inwardly projecting protrusions formed on the interior surface of the container body.

Referring to FIG. 9, is shown a preferred embodiment of the present invention. Shown is a container body 312 in its upright position having an exterior surface 314 and an interior surface 316 defining a cavity 318, the cavity divided into an upper chamber 320 and a lower chamber 322 by a barrier 324, the barrier being cooperatively configured to gravitationally rest upon at least one inwardly projecting protrusion 333 formed on the interior surface of the body. The barrier includes an upwardly facing barrier surface 347, and at least one opening 349 therethrough of sufficient dimension to selectively exclude relatively large ingredients, such as salad roughage, from entry into the lower chamber and to provide passage therethrough of relatively small food ingredients, such as granular ingredients, including, for example, ground pepper and/or such as liquids, including, for example, salad dressing, into and out of the lower chamber. The present embodiment includes an optional securable lid 313.

Operationally, with the container body 312 in its upright position and having a bottom 315, salad dressing, for example, may be loaded into the cavity 318, the dressing gravitationally settling to the bottom of the body. The selective barrier 324 may then be placed to gravitationally rest on the at least one protrusion 333. In such a resting position the barrier divides the cavity into the upper chamber 320 and the lower chamber 322. Salad roughage may then placed in the cavity on the upwardly facing barrier surface 347 and the optional lid 313 may be placed thereover. The container and its contents may then be stored, the barrier selectively separating the roughage from the dressing until the salad is ready for consumption. When ready for consumption, the lid may be removed and the container may be inverted onto a plate, the dressing from the lower chamber 322 flowing gravitationally downwardly onto the salad roughage. The body and the barrier may thereafter be removed for future use or disposed of as desired. Optionally, while the barrier is resting on the at least one protrusion, the dressing may be loaded into the lower chamber by a nozzled dispenser or otherwise poured through the at least one barrier opening 349. With the lid in place, the salad ingredients including the dressing may be shaken together in the container before the salad is served within the container or distributed onto a serving plate.

The container body, barrier, and/or lid may be formed, for example, from polystyrene, polyethylene, polypropylene, or other plastics by methods known to those of skill in the art. Such methods could include, for example, injection molding, blow molding and/or thermoforming. The at least one protrusion on the interior surface of the body may be formed as ribs, nodes, bosses, or the like or alternatively as a partially or fully annular rim or shelf sufficient to support the barrier at rest. The at least one protrusion may be added to the interior surface or may be formed as an integral part of the container body and may project inwardly from the side of the container body, upwardly from the bottom of the body, or both so as to support the barrier.

Figure 10:
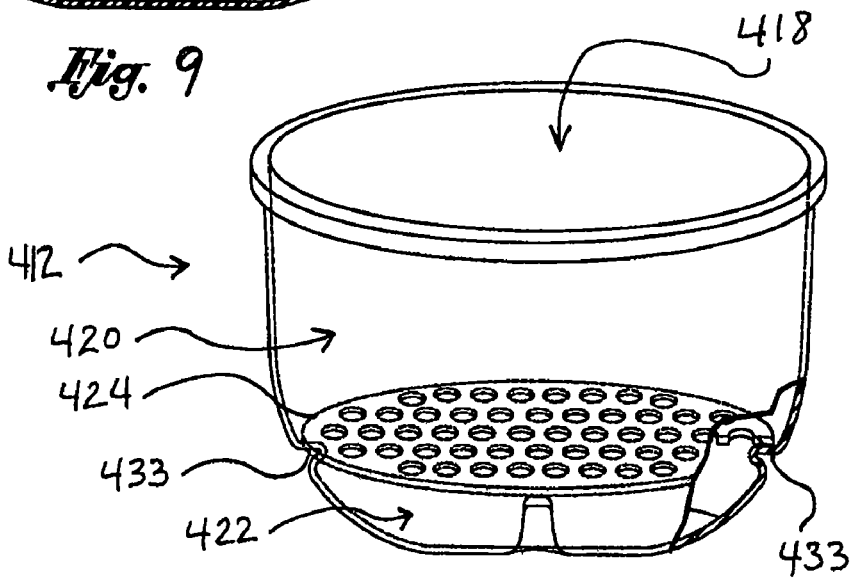
FIG. 10 is a perspective view with cutaway of an embodiment of the present invention wherein the selective barrier is at gravitational rest on a plurality of inwardly projecting protrusions integrally formed on the interior surface of the container body.

Referring to FIG. 10, is shown another embodiment of the present invention wherein the container body 412 has an open top, the barrier 424 shown gravitationally at rest upon integrally formed inwardly projecting protrusions 433, the barrier dividing the cavity into an upper chamber 420 and a lower chamber 422.

Figure 11:
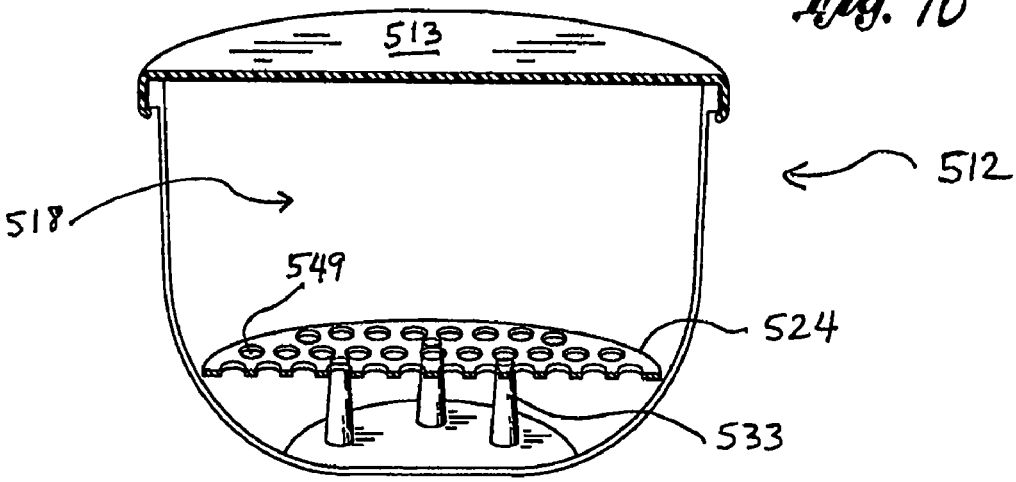
FIG. 11 is a cross-sectional perspective view of an embodiment of the present invention including a lid wherein the selective barrier is at gravitational rest on a plurality of inwardly and upwardly projecting protrusions formed on the interior surface of the container body.

Referring to FIG. 11, is shown another embodiment of the present invention. In this embodiment, inwardly projecting protrusions 533 are formed in the container body 512 and project upwardly from the bottom of the body into the cavity 518 to support the barrier 524 having at least one barrier opening 549. An optional lid 513 is provided.

In an alternative embodiment, the at least one inwardly projecting protrusion may include a slightly enlarged head or other barrier securement mechanism and be configured in alignment with the at least one barrier opening to secure the barrier from dislodging when the container is shaken or inverted. Such retention mechanisms have been known and applied in other arts such as in the music packaging art to analogously retain compact music discs in a plastic jewel case through a hole centered in the disc. Such a retention mechanism may operate to receive and releasably or permanently secure the barrier through the at least one barrier opening discouraging dislodgment of the barrier as a divider when the container is shaken or inverted.

Figure 12:
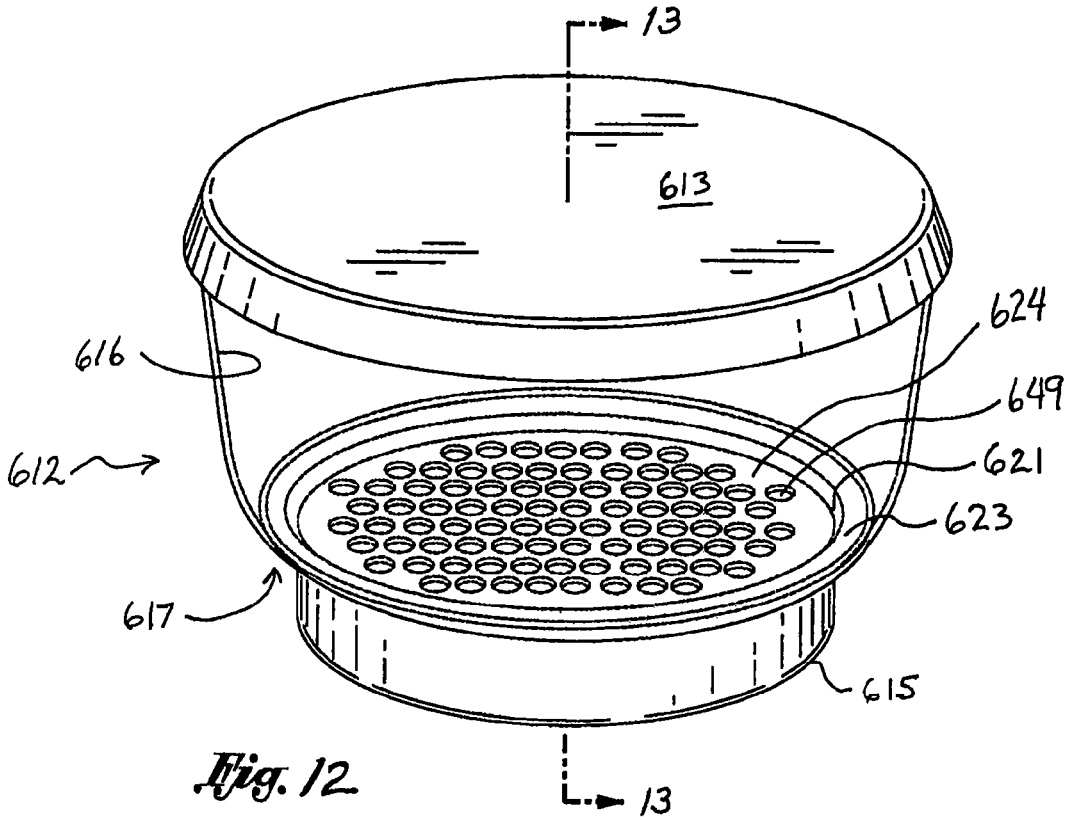
FIG. 12 is a perspective view of an embodiment of the present invention wherein the selective barrier has an upwardly angled peripheral extension further extended by a lateral flange, the barrier at rest on an inwardly projecting protrusion in the form of a seat having a front surface.
Figure 13:
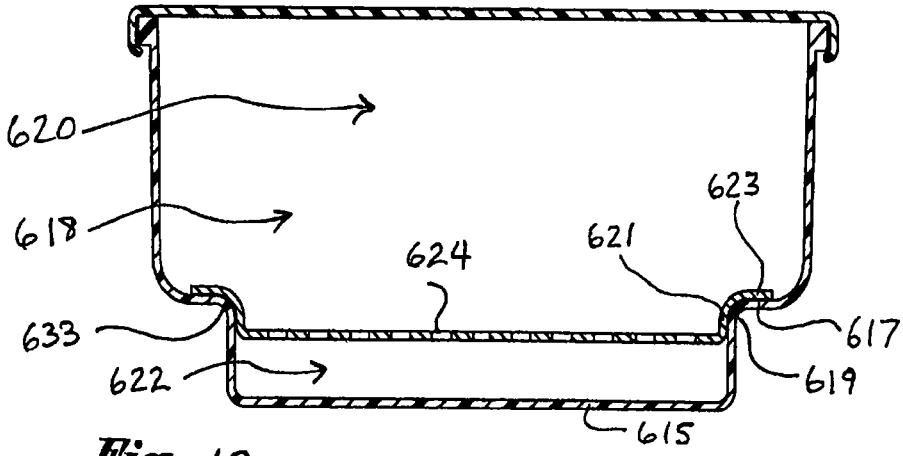
FIG. 13 is a cross-sectional view along the lines depicted in FIG. 12.

Referring to FIGS. 12 and 13, is shown another embodiment of the present invention. In this embodiment, the container body 612 having an interior surface 616, a bottom 615 and at least one inwardly projecting protrusion 633 forming a barrier seat 617 on the interior surface, the seat having a front surface 619. This embodiment also includes a barrier 624 having at least one barrier opening 649, the barrier having an upwardly angled peripheral annular extension 621 sized to frictionally wedge the peripheral extension in contact with the front surface, the barrier in the wedged position dividing the cavity into an upper chamber 620 and a lower chamber 622. The upwardly angled extension is shown further extended by a lateral flange 623 for conveniently and gravitationally resting the barrier on the seat should the upwardly angled extension, for example, be sized too narrowly for frictionally wedging with the front surface. The upwardly angled extension may be other than annular and may, for example, be in the form of opposing tabs sufficient to wedge the barrier in place and divide the cavity into an upper and lower chamber. The lateral flange may also be optionally configured as a plurality of tabs. For purposes of this application, the term "wedge" also includes press-fit.

Figure 14:
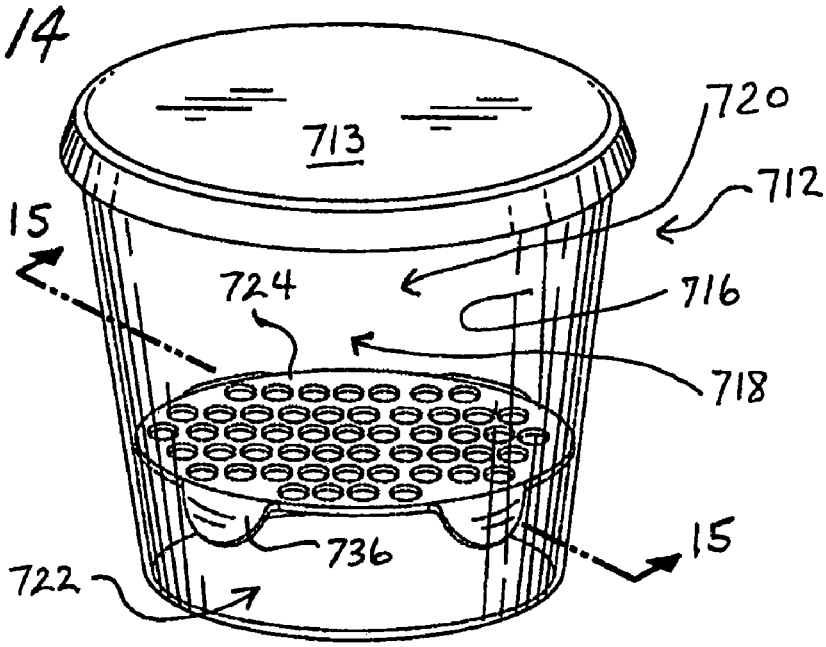
FIG. 14 is a perspective view of an embodiment of the present invention wherein the selective barrier includes peripherally downwardly projecting tabs.

Referring to FIG. 14, is shown another embodiment of the present invention. In this embodiment, the container body 712 includes an interior surface 716 at least a portion of which is tapered downwardly inward, the barrier 724 being configured cooperatively with peripherally projecting tabs 736, the tabs being sized cooperatively to frictionally interfere with the tapered portion of interior surface above the bottom of the body, the barrier dividing the cavity into an upper chamber 720 and a lower chamber 722. A lid 713 is also provided.

Alternatively, the barrier may be configured without tabs and may be formed of sufficiently pliable material such as, for example, polyethylene, and be cooperatively sized so that at least a portion of the periphery of the barrier rests on the tapered portion of the interior surface above the bottom of the body dividing the cavity into an upper chamber and a lower chamber. Optionally, the container body may be formed of a material relatively more pliant than the barrier and may be cooperatively sized to receive at least a portion of the periphery of the barrier lodging the barrier above the bottom of the body and dividing the cavity into an upper and a lower chamber.

Figure 15:
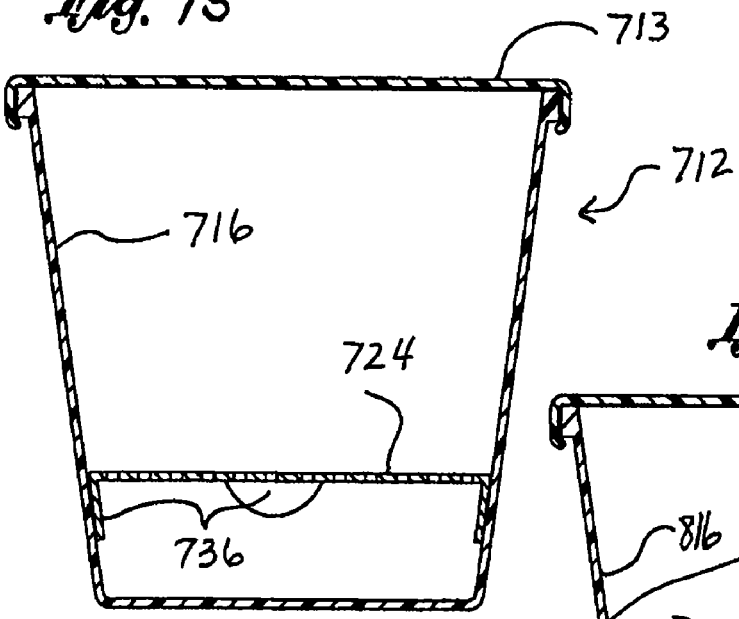
FIG. 15 is a cross-sectional view along the lines depicted in FIG. 14.
Figure 16:
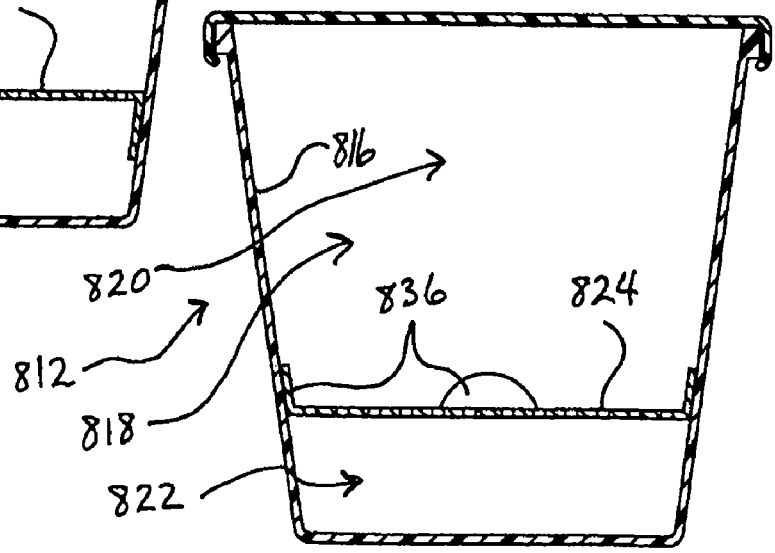
FIG. 16 is a cross-sectional view of an alternative embodiment of the present invention wherein the selective barrier includes peripherally downwardly projecting tabs.

FIG. 15 depicts a cross-section of the embodiment shown by way of arrows in FIG. 14, the tabs 736 being directed downwardly against the interior surface 716 of the container body 712. FIG. 16 shows another embodiment of the present invention having upwardly folded tabs 836 frictionally cooperating with the interior surface 816 of the container body 812 positioning the barrier 824 in the cavity 818 dividing the cavity into an upper chamber 820 and a lower chamber 822. The tabs of the present embodiments may be formed in a variety of shapes and may be comprised of a plurality or may, alternatively, take the form of a contiguous annular skirt. Optionally, the tabs may be configured to fold both upwardly and downwardly or only in one direction. The tabs and/or the annular skirt may optionally be cooperatively configured to wedge the barrier in physical contact with at least one inwardly projecting protrusion and in the wedged position the barrier dividing the cavity into an upper and a lower chamber.

Configurations of alternative embodiments of the present invention may vary considerably. The shape of the container body, for example, may be round, oval, square, or other shapes as desired and known by those skilled in the art. The upper and lower chambers too may be of varying sizes and shapes as desired.

In addition to plastics, other materials, such as, for example, rigidized paper or pulp materials may be employed as desired. Metal, such as, for example, stainless steel or aluminum may also be employed as desired consistent with the present invention. The components of the present invention may also be made from differing materials.

The salad container of the present invention may also vary in size for use in individual and/or commercial and institutional configurations. Moreover, the salad container of the present invention is not limited to containing and storing salad ingredients, but may also be used to contain and store other foodstuffs separately in the same container until ready for consumption. For example, cooked pasta may be stored in the upper chamber of the present invention and pasta sauce separately in the lower chamber. These foods may be mixed together when desired from the same container as described for salad materials desirably preserving the distinctive flavors of the foods in the separate chambers of the container until ready to be consumed.

Having described only typical forms and applications of the present invention, it is not intended that the invention be limited to the specific details herein set forth. While a particular form of the invention has been illustrated and described, it will also be apparent to those skilled in the art that various modifications can be made without departing from the spirit and scope of the invention. Accordingly, it is not intended that the invention be limited except by the appended claims.

What is claimed is:

1. A salad container comprising:

a removable lid; and a container body comprising:

an open top, a closed bottom, and a sidewall extending therebetween, the sidewall having an exterior surface, an interior surface defining a cavity between the open top and the closed bottom, and at least one protrusion projecting inwardly into the cavity;

the protrusion being an inwardly extending shoulder extending from a larger diameter upper portion of the sidewall and a smaller diameter lower portion of the sidewall, wherein the cavity is divided into an upper chamber and a lower chamber by a selective barrier extending across the cavity, the upper chamber is defined by the upper portion of the sidewall, and the lower chamber is defined by the lower portion of the sidewall, the selective barrier having an apertured planar central portion, a rim extending substantially vertically from the central portion and then forming an angled extension, the selective barrier is at least partially supported by the at least one protrusion, such that the substantially vertically extending portion of the rim is received by the sidewall, and the angled extension rests on an upper surface of the protrusion, the selective barrier being sufficiently configured to selectively exclude entry of relatively large food items into the lower chamber and to provide passage through the barrier of relatively small food ingredients both into and out of the lower chamber so that the relatively large food items are stored away from the small food ingredients until just before consumption, wherein the selective barrier is releasably secured to the body.

2. The salad container of claim 1, wherein the relatively large food items is salad and the relatively small food ingredients is salad dressing.

3. The salad container of claim 2, wherein the angled extension is upwardly angled and is cooperatively configured to wedge the selective barrier in frictional contact with the at least one protrusion.

4. The salad container of claim 3 wherein the at least one protrusion is formed as a seat.

5. The salad container of claim 4, wherein the lid is constructed such that it can serve as the bottom of the container by when the salad container is flipped over into an inverted position.

6. The salad container of claim 5, wherein the lid is further constructed to stably support the inverted container on a surface.

7. The salad container of claim 3, wherein the seat has a front surface and the barrier is cooperatively configured to wedge the barrier to the front surface.

8. The salad container of claim 3, wherein the upwardly angled extension is further extended by a lateral flange.

9. The salad container of claim 3, wherein the lid has a liquid tight seal.

10. The salad container of claim 1, wherein just before consumption the relatively small food ingredients at least partially coat the relatively large food items.

11. The salad container of claim 1, wherein the relatively small food ingredients have a viscosity greater than water.

12. The salad container of claim 1, wherein the lid is constructed such that it can serve as the bottom of the container body when the salad container is flipped over into an inverted position and shaken.

13. The salad container of claim 12, wherein the lid is further constructed to stably support the inverted container on a surface.

14. The salad container of claim 1, wherein the selective barrier is positively engaged by the container body such that it remains substantially in place.

15. The salad container of claim 14, wherein the lid is constructed such that it can serve as the bottom of the container body when the salad container is flipped over into an inverted position and shaken.

16. The salad container of claim 15, wherein the lid is further constructed to stably support the inverted container on a surface.

17. The salad container of claim 1, wherein said at least one protrusion is formed as an annular barrier retainer.

18. The salad container of claim 1, said at least one protrusion is partially annular.

19. The salad container of claim 1, wherein the removable lid is securable.

20. The salad container of claim 1, wherein the lid has a leak-resistant seal.

21. The salad container of claim 1, wherein the selective barrier is snapped into the at least one protrusion.

* * * * *